US005906035A

United States Patent [19]

Atkins

[11] Patent Number: 5,906,035

[45] Date of Patent: May 25, 1999

[54] METHOD AND APPARATUS FOR EXTENDING CONSOLES

[76] Inventor: William D. Atkins, Route 3, Box 4374-A, Osage Beach, Mo. 65065

[21] Appl. No.: 08/757,916

[22] Filed: Nov. 27, 1996

[51] Int. Cl.[6] ..... B21K 21/16

[52] U.S. Cl. ..... 29/401.1; 29/426.2; 29/525.02; 206/577; 108/12; 312/107

[58] Field of Search ..... 29/401.1, 426.1, 29/426.2, 525.01, 525.02, 525.03, 525.08; 206/577; 211/186, 189; 312/107, 108, 111, 223.1, 257.1; 108/11, 12

[56] References Cited

U.S. PATENT DOCUMENTS

| | | |
|---|---|---|
| D. 202,196 | 9/1965 | Beckman . |
| D. 216,889 | 3/1970 | Staley et al. . |
| D. 220,113 | 3/1971 | Trombly . |
| D. 222,977 | 2/1972 | Schubert et al. . |
| D. 239,350 | 3/1976 | Pohlheim . |
| D. 291,196 | 8/1987 | Ito et al. . |
| D. 300,490 | 4/1989 | Helstab . |
| D. 349,705 | 8/1994 | Ito et al. . |
| 2,404,182 | 7/1946 | Kump, Jr. . |
| 2,905,334 | 9/1959 | Gottschalk et al. . |
| 3,001,844 | 9/1961 | Spring . |
| 3,159,438 | 12/1964 | Carlson et al. . |
| 3,826,206 | 7/1974 | Ruggles . |
| 4,049,331 | 9/1977 | Gutmann, Jr. . |
| 4,363,587 | 12/1982 | Rooklyn . |
| 4,409,906 | 10/1983 | Alneng . |
| 4,986,194 | 1/1991 | Bollman . |
| 5,341,749 | 8/1994 | Noakes . |
| 5,402,501 | 3/1995 | Silfvajt et al. . |
| 5,477,337 | 12/1995 | Schuler . |

*Primary Examiner*—David P. Bryant
*Attorney, Agent, or Firm*—Senniger, Powers, Leavitt & Roedel

[57] ABSTRACT

A method for extending a console for housing equipment to provide space for housing additional equipment. An extender frame is provided which has a platform for supporting additional equipment and an appearance which is complementary to the console frame. An extender support structure is also provided. One of a plurality of console support structures is removed from a first end of the console and the extender support structure is installed proximate the first console end. In addition, the method includes the steps of installing the removed support structure proximate a first extender frame end, and connecting the extender frame to the console to form a unitary extended console for simultaneously housing the equipment and the additional equipment.

14 Claims, 7 Drawing Sheets

METHOD AND APPARATUS FOR EXTENDING CONSOLES

BACKGROUND OF THE INVENTION

This invention relates generally to a console for housing equipment such as audio equipment. In particular, the invention relates to a method and kit for extending a console to form a unitary extended console for housing additional equipment.

Many different types of equipment are used in recording and staging music and other sound or visual related presentations (e.g., theatrical performances, sports events, and news broadcasts). This equipment may include multichannel audio mixers, amplifiers, graphic equalizers, video recording and playback devices, ancillary computer equipment, as well as other stage and studio equipment. Special consoles frequently are used to house the equipment. One such console is a 90 Series Mainframe sold by Argosy Console, Inc. of Osage Beach, Miss. The various equipment is placed in the console so it is organized in a compact unit which gives the equipment a neat and professional appearance. The console also protects the equipment from damage and presents it for convenient use. However, as more equipment is needed and used, more console space is required to house the equipment. In the past, separate consoles frequently were used to house the equipment which no longer fit in a single console. In addition, auxiliary tables sometimes were set up to the sides of the console to hold the equipment. However, these alternatives detracted from the appearance of the console. Further, when auxiliary tables were used, the equipment was exposed and thus more susceptible to damage. To overcome these disadvantages, some users replaced the original console with a longer console. However, discarding the original console was wasteful and not cost effective.

SUMMARY OF THE INVENTION

Among the several objects and features of the present invention may be noted the provision of a method and kit for extending a console to house additional equipment; the provision of such a method and kit which may be disassembled and reassembled in a plurality of configurations; the provision of such a method and kit which permit subsequent extension of the extended console; and the provision of such a method and kit which provide an attractive, unitary housing.

The method of this invention is used for extending a console for housing equipment to provide space for housing additional equipment. The console includes a frame and a plurality of support structures. The console frame includes a platform adapted to support the equipment. Generally, the method comprises the steps of providing an extender frame having a platform adapted to support additional equipment and an appearance which is complementary to the console frame, providing connection means for connecting the extender frame to the console frame, and providing an extender support structure adapted for connection proximate the connection means. One of the plurality of console support structures is removed from a first end of the console frame, and the extender support structure is installed proximate the first console frame end. The removed support structure is installed proximate the first extender frame end, and the extender frame is connected to the console frame using the connection means to form a unitary extended console for simultaneously housing the equipment and the additional equipment.

In another aspect of the invention, the method generally comprises the steps of providing an extender frame and connection means. End panel means is removed from a first end of the console frame. The removed end panel means is installed proximate a first extender frame end, and the extender frame is connected to the first end of the console frame using the connection means.

In yet another aspect, the present invention is a kit for extending a console for housing equipment. Generally, the kit comprises an extender frame having opposite first and second ends, a platform adapted to support the additional equipment and an appearance which is complementary to the console frame. The kit also comprises connection means for connecting one of the ends of the extender frame to one of the ends of the console frame and an extender support structure adapted for connection proximate the connection means to support the console frame and the extender frame when the extender frame is connected to the console frame by the connection means.

Other objects and features of the invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
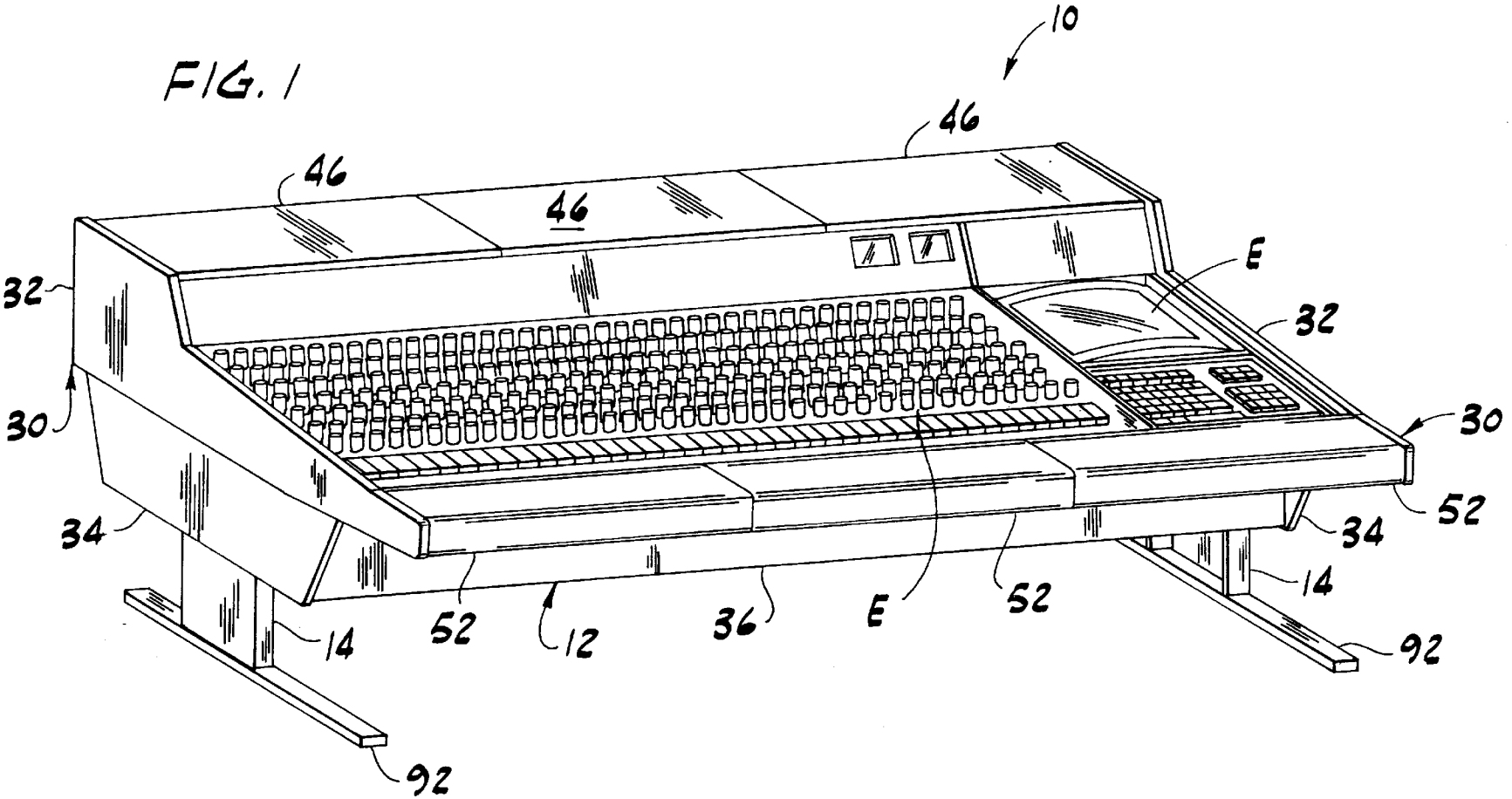
FIG. 1 is a perspective of a console with equipment installed.

The console extender of the present invention is intended for use in combination with a console such as the audio console shown in FIG. 1 and generally designated 10. The console 10 is a 90 Series Mainframe manufactured and sold by Argosy Console, Inc. of Osage Beach, Miss. This console 10 is designed specifically for use with Mackie 8-bus audio mixers although other types of equipment, such as amplifiers, graphic equalizers, and ancillary computer equipment, may also be housed in the console. The equipment housed in the console 10 is collectively designated E. Mackie 8-bus is a trademark of Mackie Design, Inc. of Woodinville, Wash.

Figure 2:
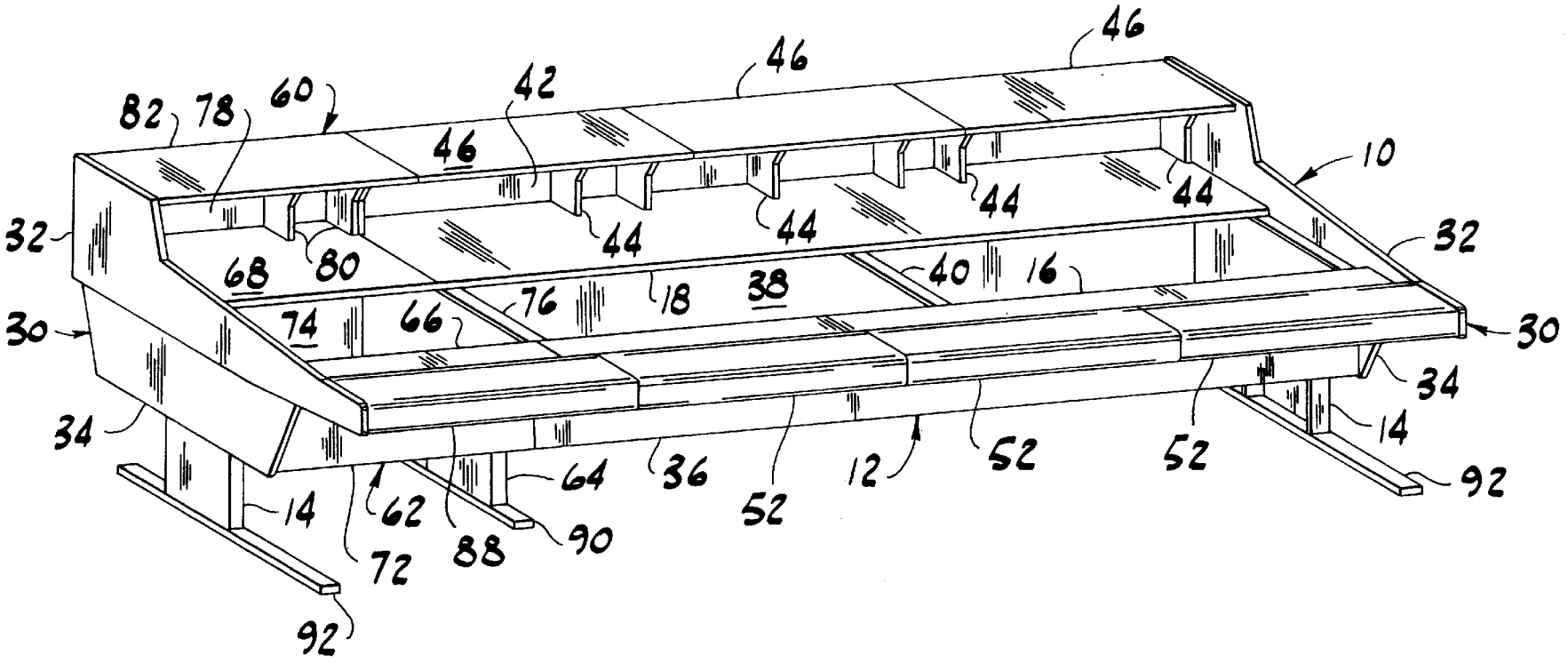
FIG. 2 is a perspective of a console having a console extender on one end.
Figure 5:
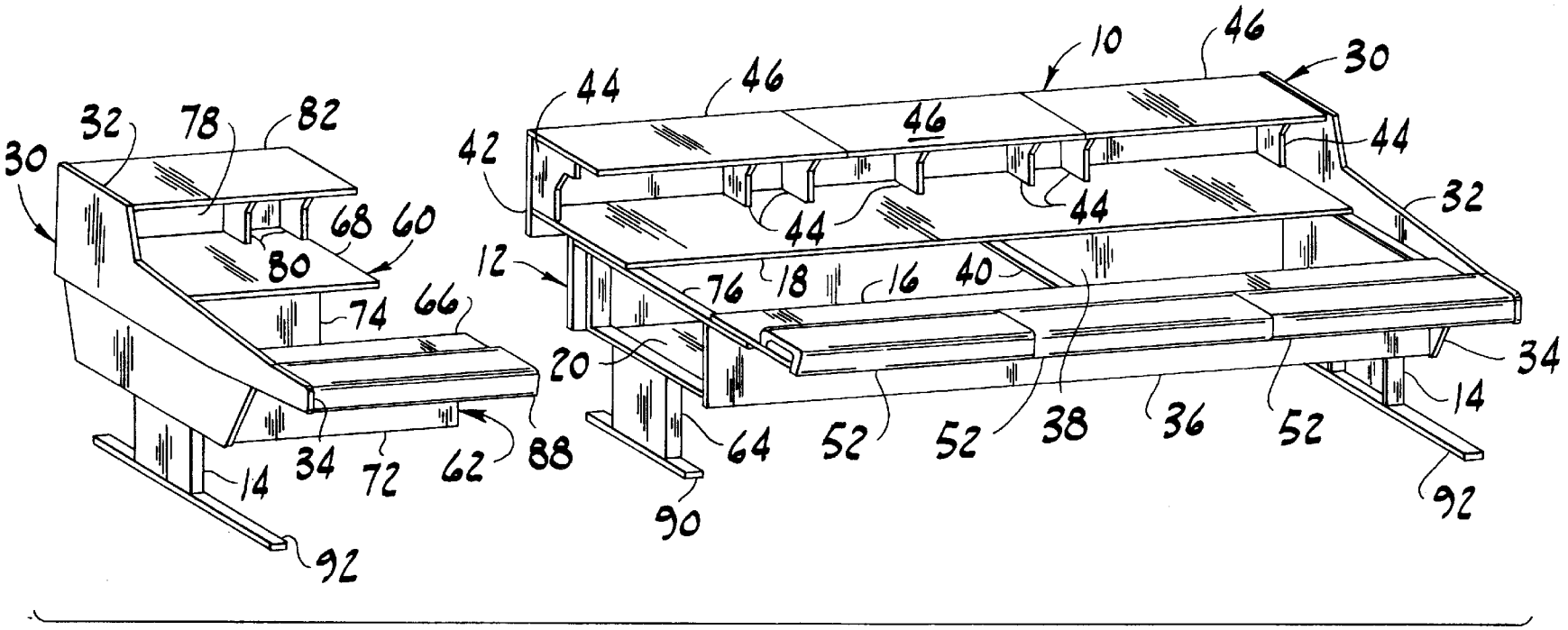
FIG. 5 is a perspective of a separated console and extender.

The console 10 generally comprises a frame generally indicated at 12 and two support structures 14 for supporting the frame. As shown in FIG. 2, the console frame 12 includes front and rear equipment platforms, 16 and 18 respectively, adapted to support the equipment E when the equipment is housed in the console 10. Further, the console frame 12 includes a lower shelf 20 (FIG. 5) which also supports some types of equipment (e.g., video monitors) and encloses the bottom of the console 10. Racks (not shown) may also be installed in the console to hold still other types of equipment E.

Returning to FIG. 1, the console frame 12 also includes end panel means, generally designated 30, comprising upper and lower panels, 32 and 34 respectively, which enclose the ends of the console frame. Front and rear panels, 36 and 38 respectively (FIG. 2), cover the forward and rearward sides of the frame 12 and support the front and rear platforms 16, 18 to prevent them from bowing under the weight of equipment E placed on the platforms. A bar 40 (FIG. 2) mounted on the upper edge of the front and rear panels 36, 38 about halfway between the console ends further supports the platforms 16, 18 and prevents them from twisting under the weight of the equipment E. The upper and lower end panels 32, 34 are also attached to the front and rear platforms 16, 18 thereby further inhibiting the platforms from twisting. In addition, a back stringer 42 (FIG. 2) attached to the rear platform 18 also supports the rear platform to prevent it from bowing or twisting. Seven brackets 44 (FIG. 2) extending between the stringer 42 and rear platform 18 provide still more support to prevent the rear platform 18 from bowing and twisting under load.

Figure 9:
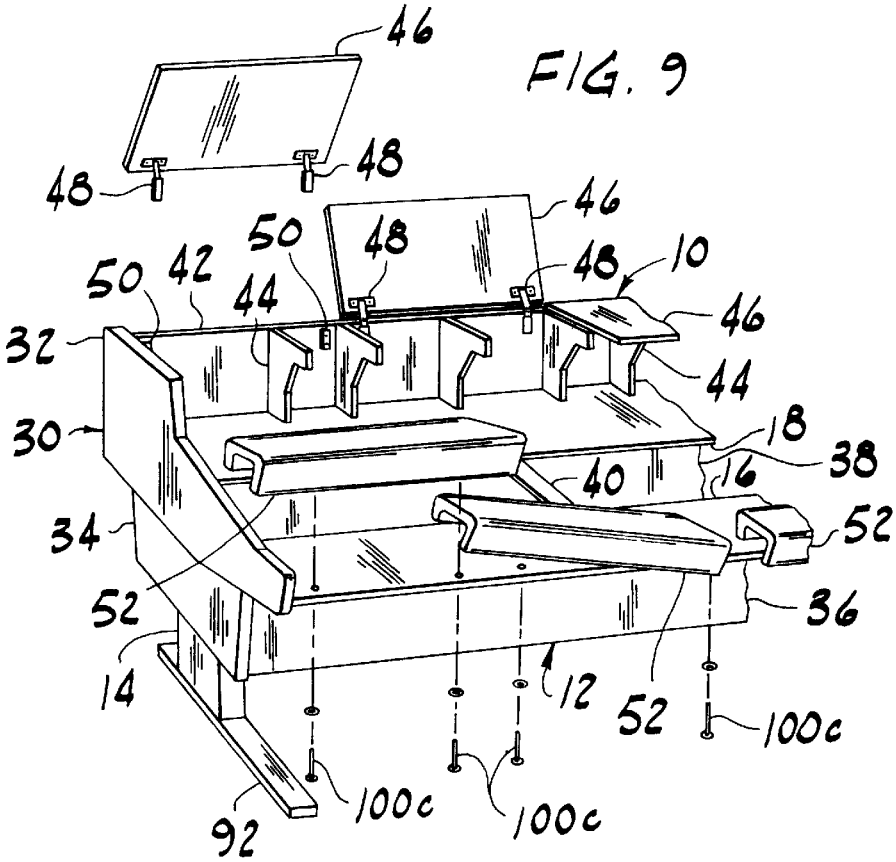
FIG. 9 is an exploded perspective illustrating final assembly of the console and extender.

Three lids 46, connected to the back stringer 42 by hinges 48 (FIG. 9) and supported by the brackets 44, cover the top of the console frame 12. The hinges 48 have releasable cleats 50 which are fastened to the back stringer 42 so the lids 46 may be separated from the console 10 or pivoted upward and rearward to provide clearance when installing and removing equipment E from the console. Armrests 52 are provided along the front margin of the front platform 16 for increasing the comfort of the user. The console components are fastened together with conventional connection means such as cam fasteners, screw fasteners, dowels and adhesives (none of which are shown) as are well known in the art.

As illustrated in FIG. 2, the console extender, generally designated 60, comprises an extender frame generally indicated at 62 and an extender support structure 64 for supporting the console frame 12 and the extender frame. The extender frame 62 includes front and rear extender platforms, 66 and 68 respectively, adapted to support additional equipment E. Further, the console frame 62 includes a lower shelf 70 (FIG. 6) which is similar to the lower shelf 20 of the console 10. One of the end panel means 30 is moved from an end of the console 10 to an end of the extender 60 during extender installation to enclose the extender end. The forward and rearward sides of the extender frame 62 are covered by front and rear panels, 72 and 74 respectively, which support the front and rear platforms 66, 68 similarly to their counterparts in the console. An extender bar 76, mounted on the upper corners of the front and rear panels 36, 38 above the extender frame 12, supports the front and rear platforms 16, 18 of the console 10 to prevent them from twisting under the weight of the equipment E when the console end panel means 30 is moved to the opposite end of the extender. The extender bar 76 also ties the panels 36, 38 together to make the extended console rigid.

A back stringer 78 attached to the rear extender platform 68 and three brackets 80 extending between the back extender stringer and rear extender platform further support the structure and prevent the rear extender platform from bowing and twisting. A lid 82 is pivotally and releasably connected to the back extender stringer 78 with hinges 84 (not shown) having releasable cleats 86 (FIG. 9) similar to the lids 46 of the console 10. An armrest 88 is provided along the front margin of the front extender platform 66 for increasing the user's comfort.

As shown in FIG. 2, the support structures 14, 64 are both pedestal-type structures having feet. The foot 90 of the extender support structure 64 does not extend toward the front of the console 10 like the feet 92 of the console support structures 14. The console feet 92 extend rearward to the front of the console 10 to stabilize the console so it does not topple rearward. Since the console feet 92 hold the extended console upright and the extender foot 90 is not needed to prevent the console from tipping, the extender foot has a shorter length so it does not interfere with an operator seated in front of the extended console.

The extender 60, the extender support structure 64 and connector means are packaged with instructions and sold as a kit for extending a console 10. The kits are specifically designed for extending consoles having particular configurations. Moreover, the extenders 60 are designed so their appearance compliments the appearance of the particular consoles they are designed to extend.

Figure 3:
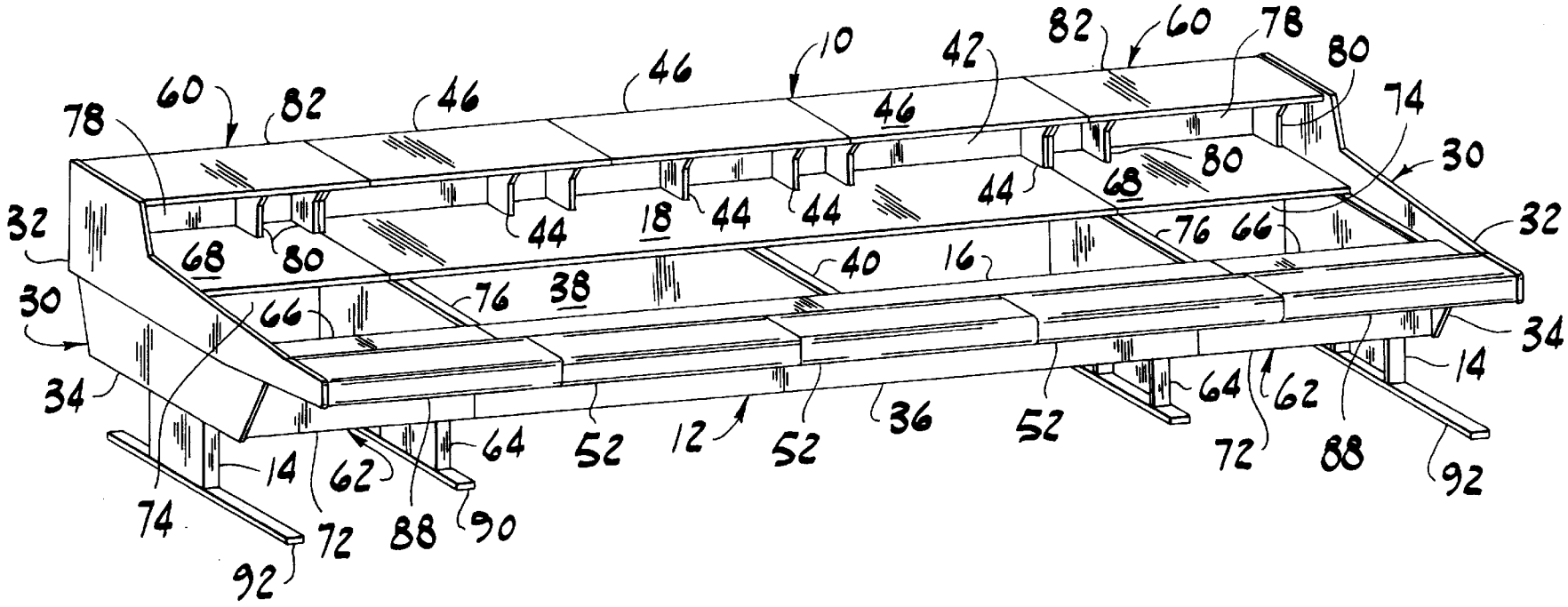
FIG. 3 is a perspective of a console having an extender on both ends.
Figure 4:
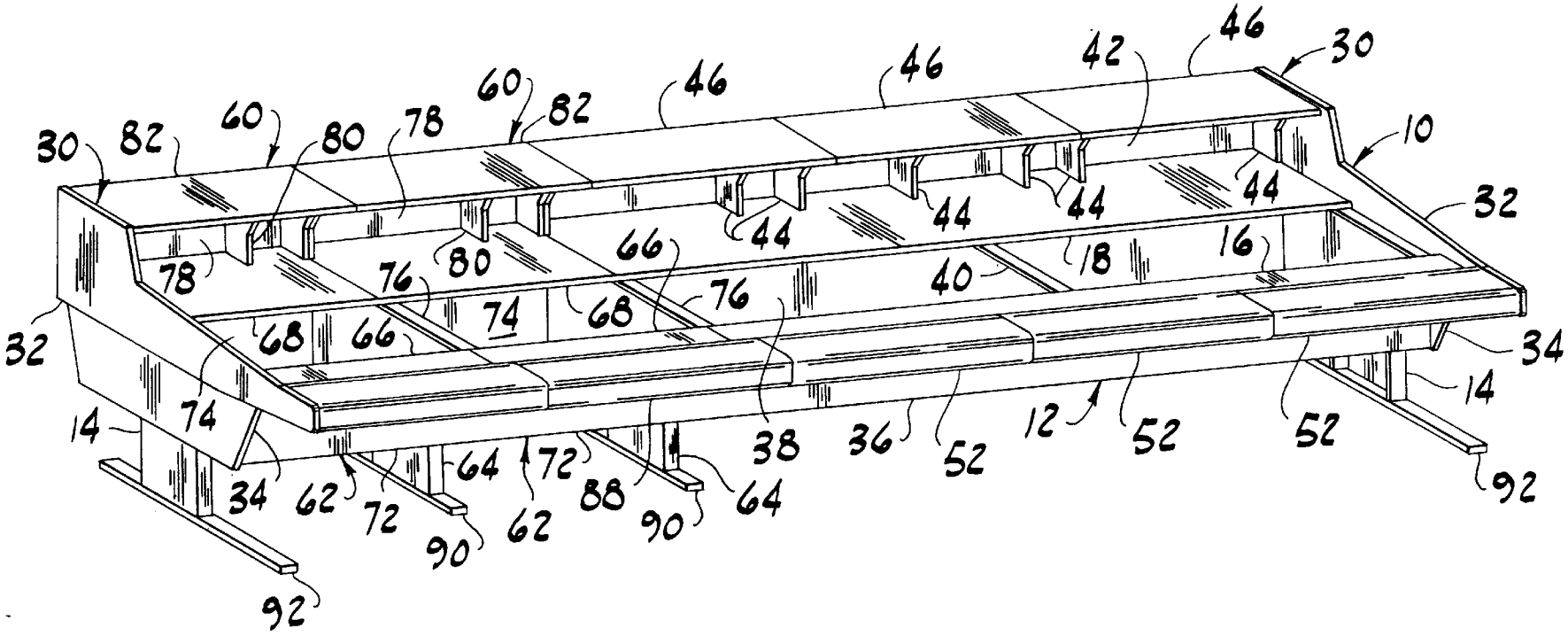
FIG. 4 is a perspective of a console having two extenders on one end.

Because the extender 60 may be attached to either the left or right ends of the original console 10 or to an extender, the kit may be used to produce many different extended console configurations. For instance, one extender may be connected to one end of the console as shown in FIG. 2. Alternatively, an extender may connected to each end of the console as shown in FIG. 3. Still further, two extenders may be connected to one end of the console as shown in FIG. 4.

Figure 6:
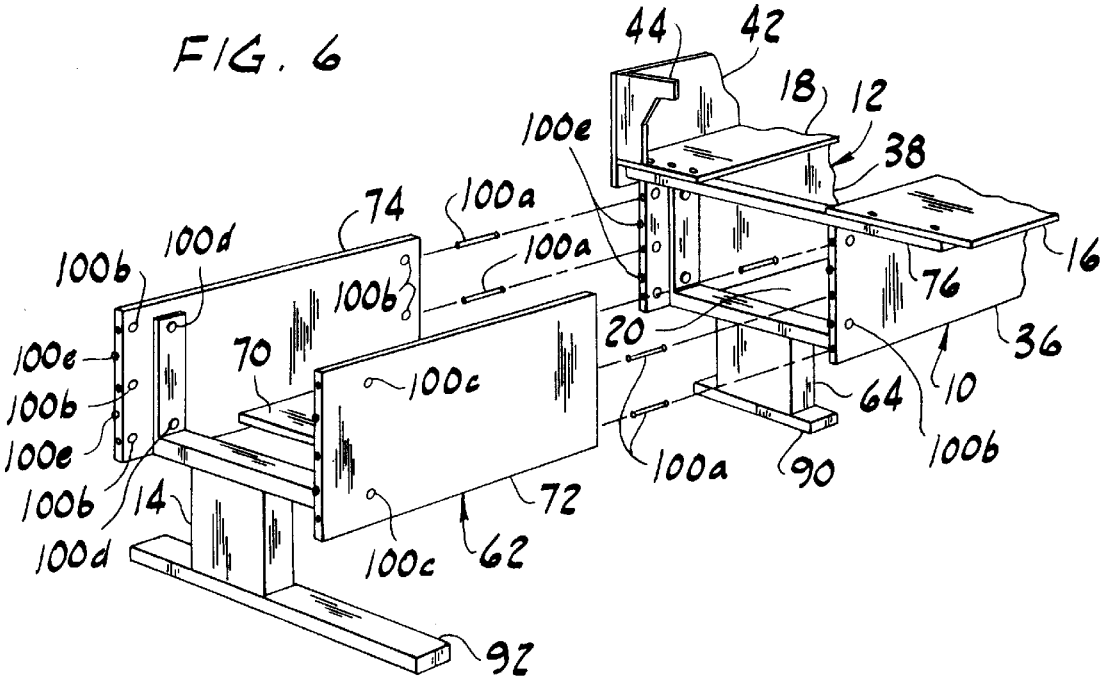
FIG. 6 is an exploded perspective illustrating assembly of an extender frame to the console.

Various conventional connection means may be used to connect the components of the extender 60 and to connect the extender to the console 10. For instance, the connection means may include screw fasteners, cam-lock fasteners, dowels, adhesives or combinations of these connectors. The particular connection means shown in FIG. 6 are double cam connectors 100*a*, cam locks 100*b*, bolts 100*c*, nuts load and dowels 100*e*. As each of the connection means is conventional and well understood by those of ordinary skill in the art, further explanation regarding these means and their methods of use will not be given.

In the preferred embodiment, each of the console and extender panels is made from wood. However, other materials may be used to form the panels without departing from the invention. Likewise, although the support structures of the preferred embodiment are fashioned from metal, other materials may be used without departing from the scope of the present invention.

The method of assembling an extender 60 to a console 10 is illustrated in FIGS. 6–9. Prior to beginning, it is advisable to remove any equipment from the console 10. To avoid damaging the armrests 52 while installing the extender 60, they may be removed by unscrewing the fasteners holding them in place. Before connecting the extender 60 to the console 10, the end panel means 30 must be removed from the end of the console to which the extender will be connected. To remove the end panel means 30, the cam locks 100*b* are turned to release the heads of the cam screws (not shown) holding the panels in place.

As shown in FIG. 6, the extender bar 76 is installed between the forward and rear console panels 36, 38 and fastened in place using bolts. Then the console support structure 14 on the end of the console 10 to be extended is replaced with the extender support structure 64. The removed console support structure 14 is then installed proximate the end of the extender frame 62 opposite the end which will be connected to the console 10. Both the console and extender support structures are fastened in place using nuts 100*d* and bolts 100*c*.

Figure 7:
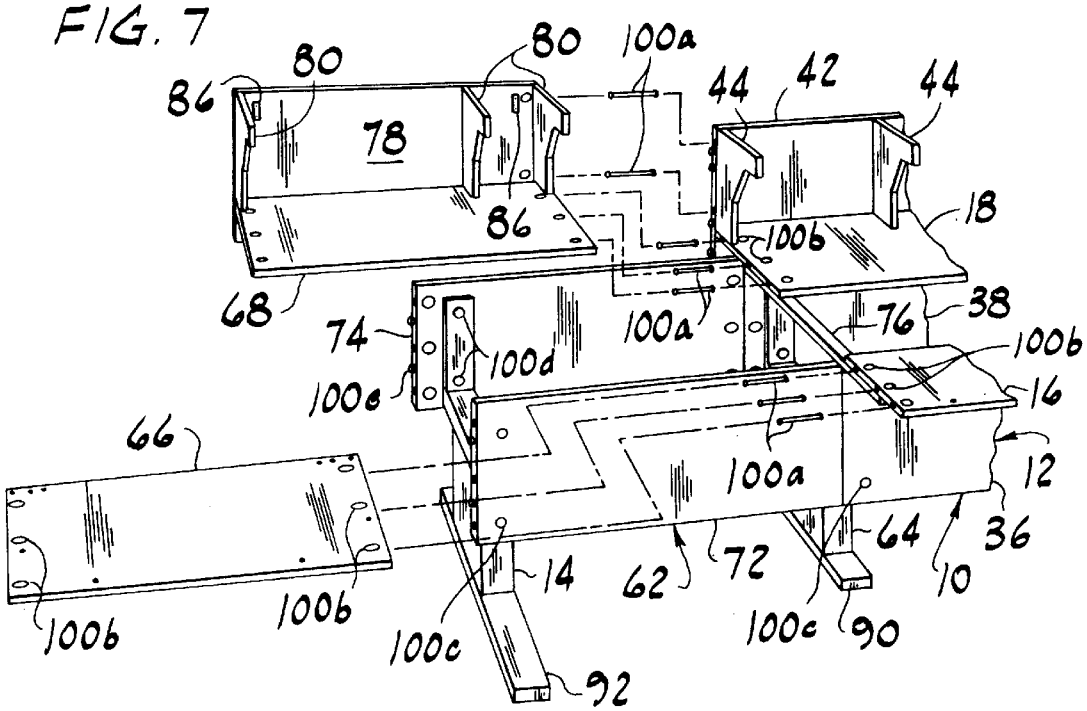
FIG. 7 is an exploded perspective illustrating assembly of platforms to the console and extender frame.

In the preferred method, the extender frame 62 is assembled on the removed console support structure 14 by bolting the forward and rearward extender panels 72, 74 to the support structure as shown in FIG. 6. Then the back extender platform 68, brackets 80 and back stringer 78 are fastened together using cam-locks and cam-screws to form a back platform assembly as shown in FIG. 7. This assembly is fastened to the console 10 and to the rear extender panel 74 using double cam connectors, cam locks and dowels. Likewise, the front platform 66 is fastened to the front console platform 16 and to the front extender panel 72 using double cam connectors and cam locks as also shown in FIG. 7.

Figure 8:
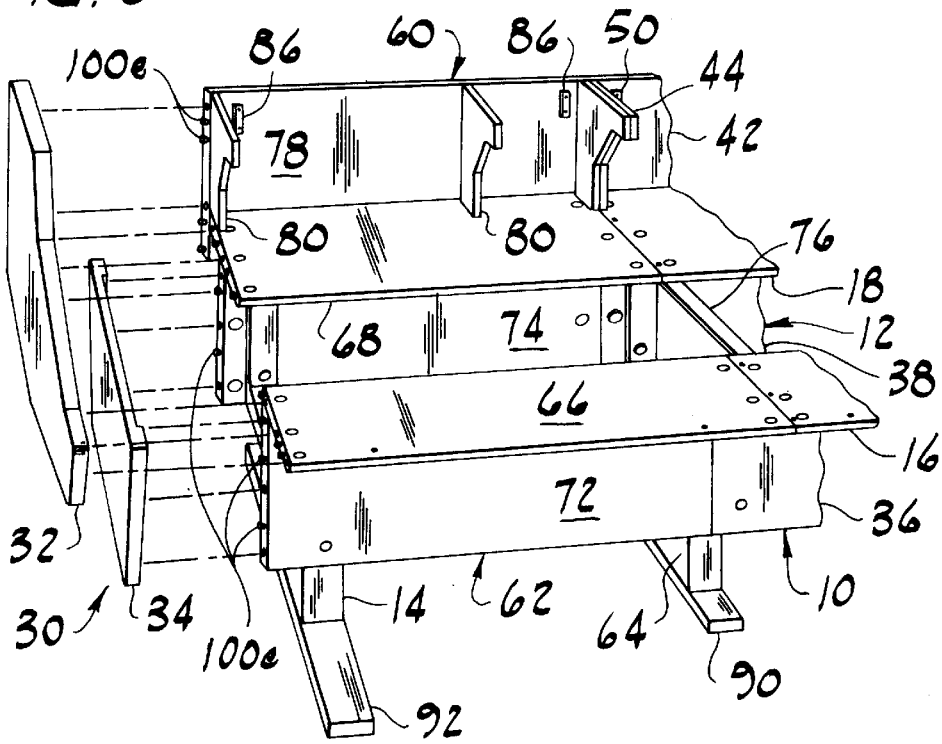
FIG. 8 is an exploded perspective illustrating assembly of end panel means to the console and extender.

Once the extender frame 62 is connected to the console frame 12, the end panels 32, 34 are installed on the extender frame as shown in FIG. 8. The armrests 52, 88 are then fastened to the forward platforms 16, 66 using bolts 100*c*, and the lids 46, 82 are connected to the rearward platform assemblies. At this point, the equipment E may be reinstalled into the extended console.

The term panel means is used herein to describe the end panels which may be unitary or multi-part, which may be made of one or more materials, and which may be flat or rounded. The term connection means is used herein to describe any type of connectors, including screw fasteners, cam-lock fasteners, adhesives and any other conventional means for connecting two structures together. The term support structure is used herein to describe any support structure such as those shown which support the console. The structure may include legs or pedestals. Further, the structure may include feet as shown for stability.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A method for extending a console for housing equipment to provide space for housing additional equipment, the console including a frame having opposite first and second ends, at least two end panel means, and a support structure for supporting the console frame, one of said end panel means being positioned adjacent each of said first and second console frame ends, the console frame including a platform adapted to support said equipment when the equipment is housed in the console, the method comprising the steps of:

providing an extender frame having opposite first and second ends, a platform adapted to support said additional equipment, a support structure for supporting the extender frame, and an appearance which is complementary to the console frame;

providing connection means for connecting said second end of the extender frame to said first end of the console frame;

removing said console end panel means from said first end of the console frame;

installing the removed end panel means proximate said first extender frame end; and connecting said second end of the extender frame to said first end of the console frame using said connection means to thereby form a unitary extended console having panel means at each end of the unitary extended console and to simultaneously house the equipment and said additional equipment.

2. A kit for extending a console housing equipment to provide space for housing additional equipment, the console including a frame having opposite first and second ends and a plurality of support structures, one of said plurality of support structures being positioned adjacent each of said first and second console frame ends for supporting said first and second console frame ends, the console frame including a platform adapted to support said equipment when the equipment is housed in the console, the kit comprising:

an extender frame having opposite first and second ends, a platform adapted to support said additional equipment and an appearance which is complementary to the console frame;

connection means for connecting one of said first and second ends of the extender frame to one of said first and second ends of the console frame;

an extender support structure adapted for connection proximate the connection means to support the console frame and the extender frame when the extender frame is connected to the console frame by said connection means, each of the console and extender support structures having a foot for supporting the support structures, the foot of the extender support structure having a shorter length than the feet of the console support structures positioned adjacent said first and second console frame ends.

3. A kit for extending a console as set forth in claim 2 wherein said extender frame constitutes a first extender frame, said connection means constitutes first connection means, said extender support structure constitutes a first extender support structure, and said kit further comprises:

a second extender frame having opposite first and second ends, a platform adapted to support more equipment and an appearance which is complementary to the console frame and said first extender frame;

second connection means for connecting one of said first and second ends of said second extender frame to one of said ends of the console frame and said first extender frame;

a second extender support structure adapted for connection proximate said second connection means to support said second extender frame.

4. A kit for extending a console as set forth in claim 2 wherein said connection means includes a member adapted to extend between the console frame and the extender frame, and a plurality of fasteners for fastening the member to the console frame and the extender frame to thereby connect the extender frame to the console frame.

5. A kit for extending a console as set forth in claim 4 wherein:

the member is a double cam connector; and each of the plurality of fasteners is a camlock fastener.

6. A kit for extending a console as set forth in claim 2 in combination with the console.

7. A kit for extending a console as set forth in claim 2 wherein the extender support structure foot has a length which is sufficiently short that the foot will not interfere with an operator seated at the extended console when the extender support structure is connected proximate the connection means and the extender frame is connected to the console frame by said connection means.

8. A method for using the kit set forth in claim 2, the method comprising the steps of:

installing the extender support structure proximate said first console frame end to support said first end of the console frame;

installing a console support structure proximate said first extender frame end to support said first extender frame end; and connecting said second end of the extender frame to said first end of the console frame using said connection means to thereby support said second end of the extender frame with the extender support structure and to form a unitary extended console for simultaneously housing the equipment and said additional equipment.

9. A method for extending a console for housing equipment to provide space for housing additional equipment, the console including a frame having opposite first and second ends and a plurality of support structures, one of said plurality of support structures being positioned adjacent each of said first and second console frame ends for supporting said first and second console frame ends, the console frame including a platform adapted to support said equipment when the equipment is housed in the console, the method comprising the steps of:

providing an extender frame having opposite first and second ends, a platform adapted to support said additional equipment and an appearance which is complementary to the console frame;

providing connection means for connecting said second end of the extender frame to said first end of the console frame;

providing an extender support structure adapted for connection proximate the connection means to support the console frame and the extender frame when the extender frame is connected to the console frame by said connection means;

removing one of said plurality of console support structures from said first end of the console frame;

installing the extender support structure proximate said first console frame end to support said first end of the console frame in place of the removed support structures;

installing the removed console support structure proximate said first extender frame end to support said first extender frame end; and connecting said second end of the extender frame to said first end of the console frame using said connection means to form a unitary extended console for simultaneously housing the equipment and said additional equipment.

10. A method for extending a console as set forth in claim 9 wherein said extender frame constitutes a first extender frame, said connection means constitutes first connection means, said extender support structure constitutes a first extender support structure, and said method further comprises the steps of:

providing a second extender frame having opposite first and second ends, a platform adapted to support more equipment and an appearance which is complementary to the console frame and said first extender frame;

providing second connection means for connecting said first end of said second extender frame to said second end of the console frame;

providing a second extender support structure adapted for connection proximate said second connection means to support the console frame and said second extender frame when said second extender frame is connected to the console frame by said connection means;

removing one of said plurality of console support structures from said second end of the console frame;

installing said second extender support structure proximate said second end of the console frame to support said second end of the console frame in place of the removed support structure;

installing the removed support structure proximate said second end of said second extender frame to support said second end of said second extender frame; and connecting said first end of said second extender frame to said second end of the console frame using said second connection means to thereby support said first end of said second extender frame with said second extender support structure and to form a unitary extended console for simultaneously housing the equipment, said additional equipment and said more equipment.

11. A method for extending a console as set forth in claim 9 wherein said extender frame constitutes a first extender frame, said connection means constitutes first connection means, said extender support structure constitutes a first extender support structure, and said method further comprises the steps of:

providing a second extender frame having opposite first and second ends, a platform adapted to support more equipment and an appearance which is complementary to the console frame and said first extender frame;

providing second connection means for connecting said second end of said second extender frame to said first end of said first extender frame;

providing a second extender support structure adapted for connection proximate said second connection means to support said first and second extender frames when said second extender frame is connected to said first extender frame by said connection means;

removing one of said plurality of said console support structures from said first end of said first extender frame;

installing said second extender support structure proximate said first end of said first extender frame to support said first end of said extender frame in place of the removed support structure;

installing the removed support structure proximate said first end of said second extender frame to support said first end of said second extender frame; and connecting said second end of said second extender frame to said first end of said first extender frame using said second connection means to thereby support said second end of said second extender frame with said second extender support structure and to form a unitary extended console for simultaneously housing the equipment, said additional equipment and said more equipment.

12. A method for extending a console as set forth in claim 9 wherein said first end of the console frame constitutes a left end of the console frame and said first end of the extender frame constitutes a left end of the extender frame.

13. A method for extending a console as set forth in claim 9 wherein said first end of the console frame constitutes a right end of the console frame and said first end of the extender frame constitutes a right end of the extender frame.

14. A method for extending a console as set forth in claim 9 wherein the console includes at least two end panel means, one of said end panel means being positioned adjacent each of said first and second console frame ends, and said method further comprises the steps of:

removing said console end panel means from said first end of the console frame prior to connecting said second end of the extender frame to said first end of the console frame; and installing the removed end panel means proximate said first extender frame end.

* * * * *